US006609630B1

(12) United States Patent
Freeman et al.

(10) Patent No.: US 6,609,630 B1
(45) Date of Patent: Aug. 26, 2003

(54) LEAK-PROOF CLOSURE APPARATUS

(76) Inventors: Mark A. Freeman, 8928 Twilight, Lenexa, KS (US) 66219; Timothy K. Stringer, 8921 W. 80th, Overland Park, KS (US) 66204

( * ) Notice: Subject to any disclaimer, the term of this patent is extended or adjusted under 35 U.S.C. 154(b) by 0 days.

(21) Appl. No.: 09/296,880

(22) Filed: Apr. 22, 1999

(51) Int. Cl.[7] ..... B65D 39/08

(52) U.S. Cl. ..... 220/714; 220/717; 220/203.19; 220/203.11; 220/203.29; 215/11.5; 215/11.4

(58) Field of Search ..... 220/203.18, 203.01, 220/203.11, 203.15, 203.16, 203.17, 203.19, 203.29, 254, 714, 717, 719, 720; 215/11.5, 11.4, 309; 222/632, 335, 397, 490

(56) References Cited

U.S. PATENT DOCUMENTS

| | | | | | |
|---|---|---|---|---|---|
| 2,534,614 | A | | 12/1950 | Michael | |
| 2,569,139 | A | | 9/1951 | Abelson | |
| 2,816,548 | A | | 12/1957 | Tupper | |
| 3,372,832 | A | | 3/1968 | Yeater et al. | |
| 3,406,862 | A | * | 10/1968 | Donaldson | 220/203.17 |
| 3,840,153 | A | | 10/1974 | Devlin | |
| 3,905,512 | A | | 9/1975 | Albert et al. | |
| 3,964,631 | A | | 6/1976 | Albert | |
| 4,138,033 | A | | 2/1979 | Payne et al. | |
| 4,238,045 | A | | 12/1980 | D'Andria | |
| 4,245,752 | A | | 1/1981 | Prueher | |
| 4,361,249 | A | | 11/1982 | Tuneski et al. | |
| 4,441,624 | A | | 4/1984 | Sokolowski | |
| 4,460,101 | A | * | 7/1984 | Tseng | 220/719 |
| 4,582,214 | A | | 4/1986 | Dart et al. | |
| 4,616,768 | A | * | 10/1986 | Flier | 222/92 |
| 4,691,836 | A | * | 9/1987 | Wassilieff | 215/298 |
| 4,756,440 | A | | 7/1988 | Gartner | |
| 4,796,774 | A | | 1/1989 | Nabinger | |
| 4,877,624 | A | * | 10/1989 | Floyd et al. | 220/203.11 |
| 4,896,789 | A | * | 1/1990 | Federspiel | 220/203.17 |
| 4,921,112 | A | | 5/1990 | Juhlin et al. | |
| 4,946,062 | A | | 8/1990 | Coy | |
| 5,050,758 | A | | 9/1991 | Freeman et al. | |
| 5,082,134 | A | | 1/1992 | Ramsey | |
| 5,115,950 | A | | 5/1992 | Rohr | |
| 5,186,347 | A | | 2/1993 | Freeman et al. | |
| 5,250,266 | A | * | 10/1993 | Kanner | 220/203.17 |
| 5,339,995 | A | * | 8/1994 | Brown et al. | 220/203.17 |
| 5,388,615 | A | * | 2/1995 | Edlund et al. | 220/203.18 |
| 5,395,590 | A | * | 3/1995 | Swaniger et al. | 220/203.18 |
| 5,409,144 | A | * | 4/1995 | Brown | 220/203.17 |
| 5,472,122 | A | | 12/1995 | Appleby | |
| 5,542,670 | A | | 8/1996 | Morano | |
| 5,553,726 | A | | 9/1996 | Park | |
| 5,560,513 | A | | 10/1996 | Jarrell | |
| 5,582,315 | A | | 12/1996 | Reid | |
| 5,607,073 | A | | 3/1997 | Forrer | |
| 5,676,289 | A | | 10/1997 | Gross et al. | |
| 5,702,025 | A | | 12/1997 | Gregorio | |
| 5,706,972 | A | | 1/1998 | Sousa | |
| 5,706,973 | A | | 1/1998 | Robbins, III et al. | |
| 5,747,083 | A | * | 5/1998 | Raymond et al. | 215/11.3 |
| 5,850,908 | A | | 12/1998 | Jasek | |
| 5,873,478 | A | | 2/1999 | Sullivan | |
| 5,890,619 | A | | 4/1999 | Belanger | |
| 5,890,620 | A | | 4/1999 | Belcastro | |
| 5,890,621 | A | | 4/1999 | Bachman et al. | |
| 5,988,425 | A | * | 11/1999 | Yehl et al. | 220/717 X |

FOREIGN PATENT DOCUMENTS

| | | |
|---|---|---|
| EP | 0 807 584 A1 | 11/1997 |
| GB | 2262045 | 4/1996 |
| GB | 2317608 | 4/1998 |
| WO | WO 99/08578 | 2/1999 |

* cited by examiner

*Primary Examiner*—Joseph M. Moy

(57) ABSTRACT

A leak-proof closure (10) for dispensing liquid beverages from a container. The closure (10) contains a outlet passage (14) which is open at both ends. Within outlet passage (14) there is a membrane (13) which denies communication between the interior of the container and the flow opening (15). When external suction is applied to the end of outlet passage (14), membrane (13) sealingly disengages from circumferential seal member (12). This allows the contained beverage to egress through the flow opening (15). When the external suction is removed, membrane (13) automatically sealingly engages with circumferential seal member (12).

20 Claims, 13 Drawing Sheets

LEAK-PROOF CLOSURE APPARATUS

BACKGROUND—Field of the Invention

This invention relates to a closure for a beverage container and is particularly concerned with closures which remain in place while drinking and are leak-proof.

BACKGROUND—Description of Prior Art

In some prior art arrangements, the closures have an outlet passage containing an opening. Within the outlet passage there is a membrane which is slit creating a valve which can be activated by suction from the user. When suction is applied, the slit forms an opening and provides a flow opening for withdrawal of the contained liquid. The disadvantage of prior art arrangements of this approach is the membrane requires a secondary operation (formation of the slit) during manufacturing. Another disadvantage is the membrane becomes distorted over time and loses its ability to form a leak-proof seal.

OBJECTIVES AND ADVANTAGES

The main objective of the present invention is to provide a closure which overcomes the disadvantages previously stated.

Another objective of the present invention is to provide a closure for a container, specifically designed to handle liquid beverages, that provides a means of communication between the interior and exterior of the container only when withdrawal of the liquid beverage is desired.

It is a further objective of the present invention to provide a means for denying communication which does not require a self-sealing slit.

DRAWING FIGURES

REFERENCE NUMERALS IN DRAWINGS

Figure 1:
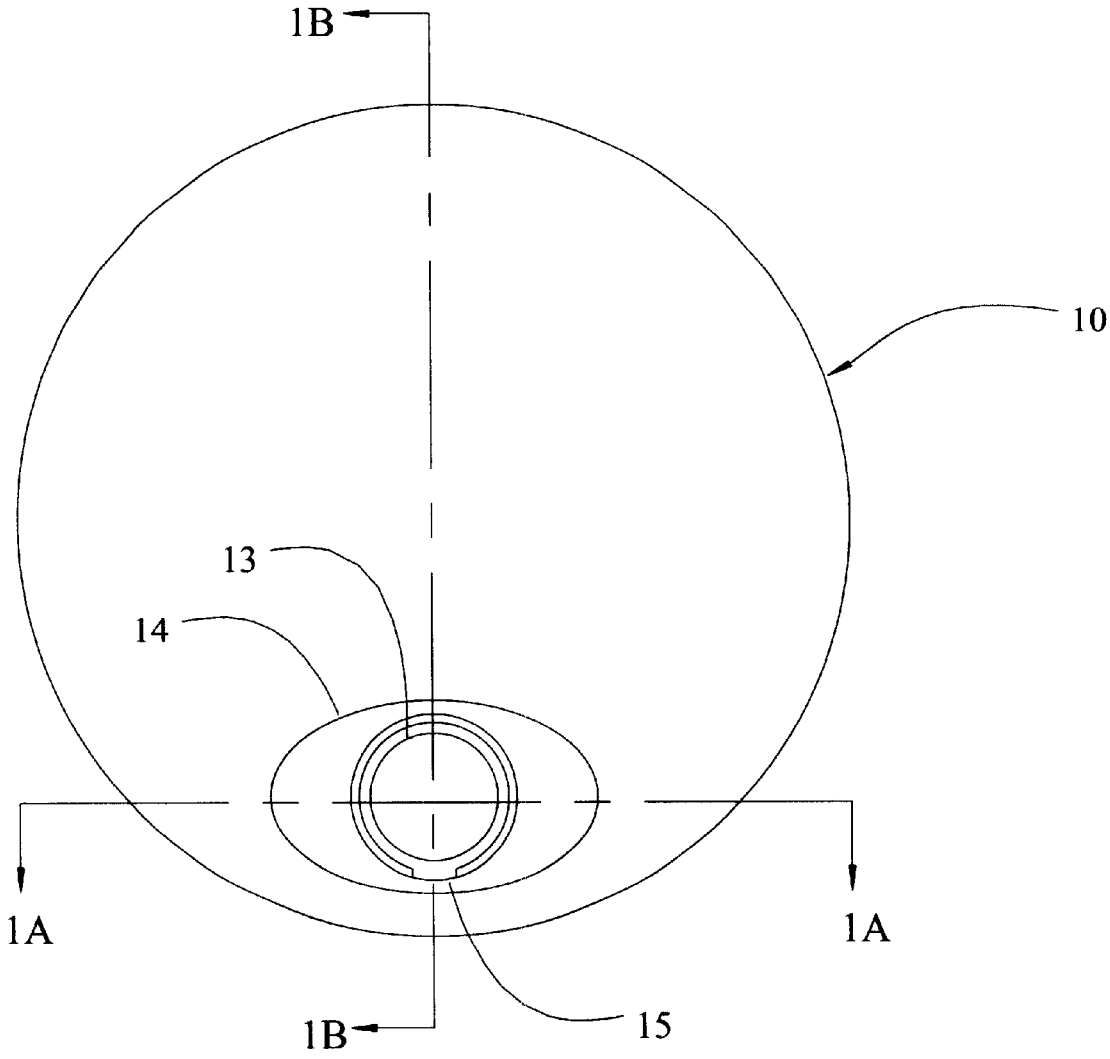
FIG. 1 is a top view of a leak-proof closure in the closed position.

10 Closure
11 Inner wall
12 Circumferential seal member
13 Membrane
14 Outlet passage
15 Flow opening
16 Retainer ring
17 Valve assembly

SUMMARY

A closure for use in dispensing a beverage from a container. The closure has a outlet passage opened at both ends. Within the outlet passage is a membrane and a circumferential seal member which function together as a flow valve controlled by the user.

Description—FIGS. 1 through 5A

Figure 2:
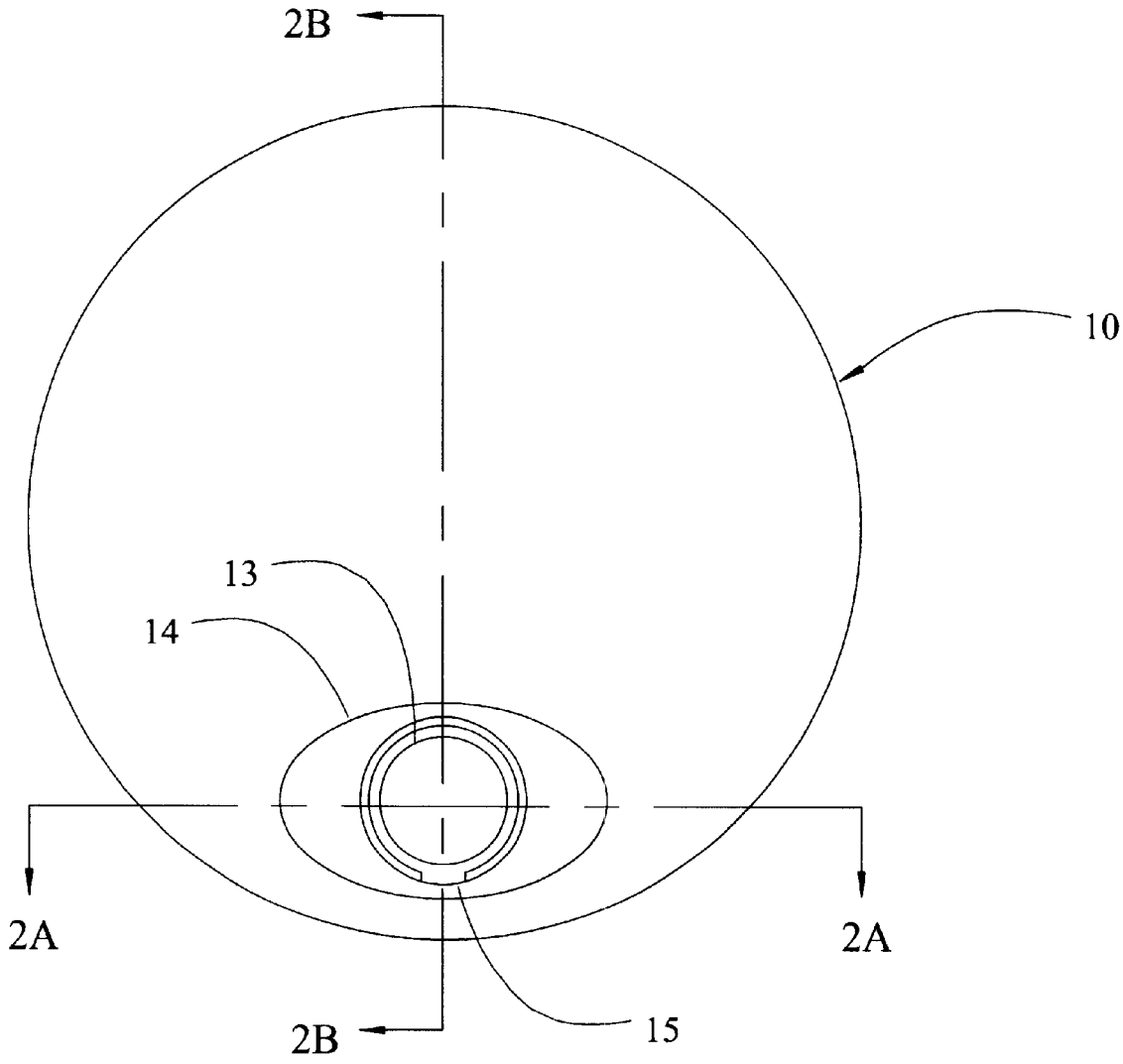
FIG. 2 is a top view of a leak-proof closure in the opened position as a result of suction applied by the user. The opened and closed positions, shown in FIG. 2 and FIG. 1 respectively, cannot be distinguished from a top view.
Figure 2A:
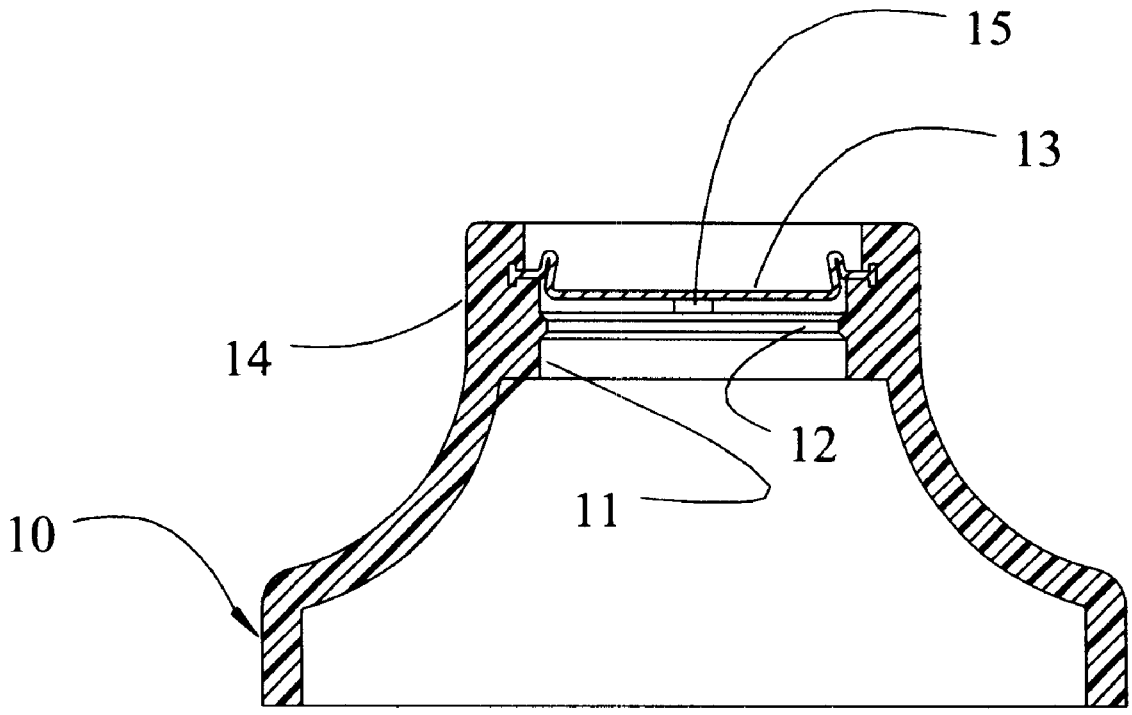
FIG. 2A is the cross-sectional view taken as indicated by section 2A—2A applied to FIG. 2.
Figure 2B:
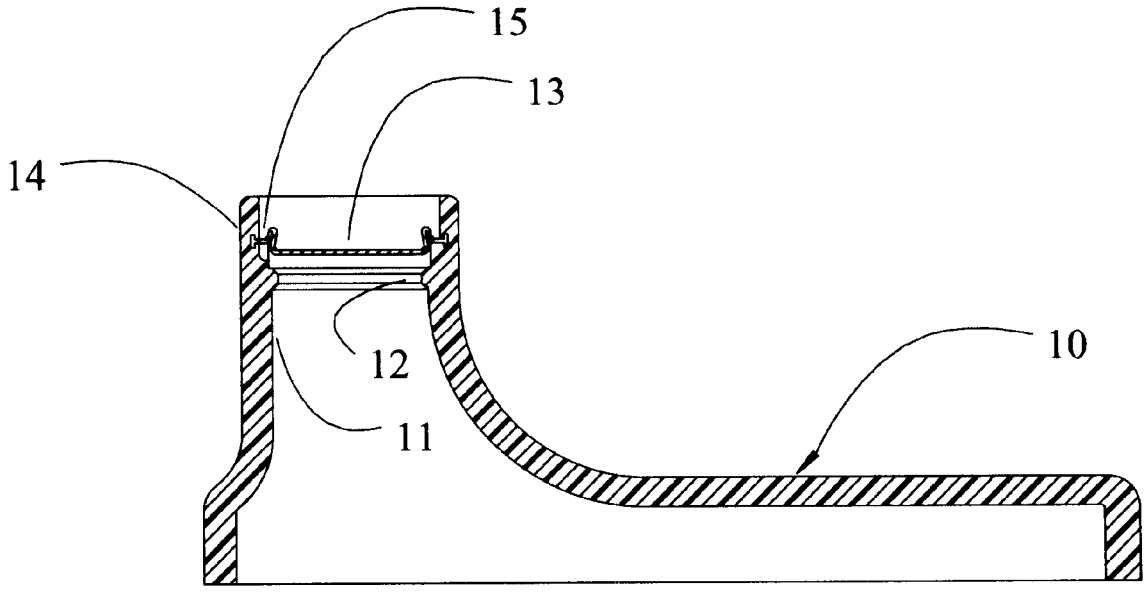
FIG. 2B is the cross-sectional view taken as indicated by section 2B—2B applied to FIG. 2.
Figure 3:
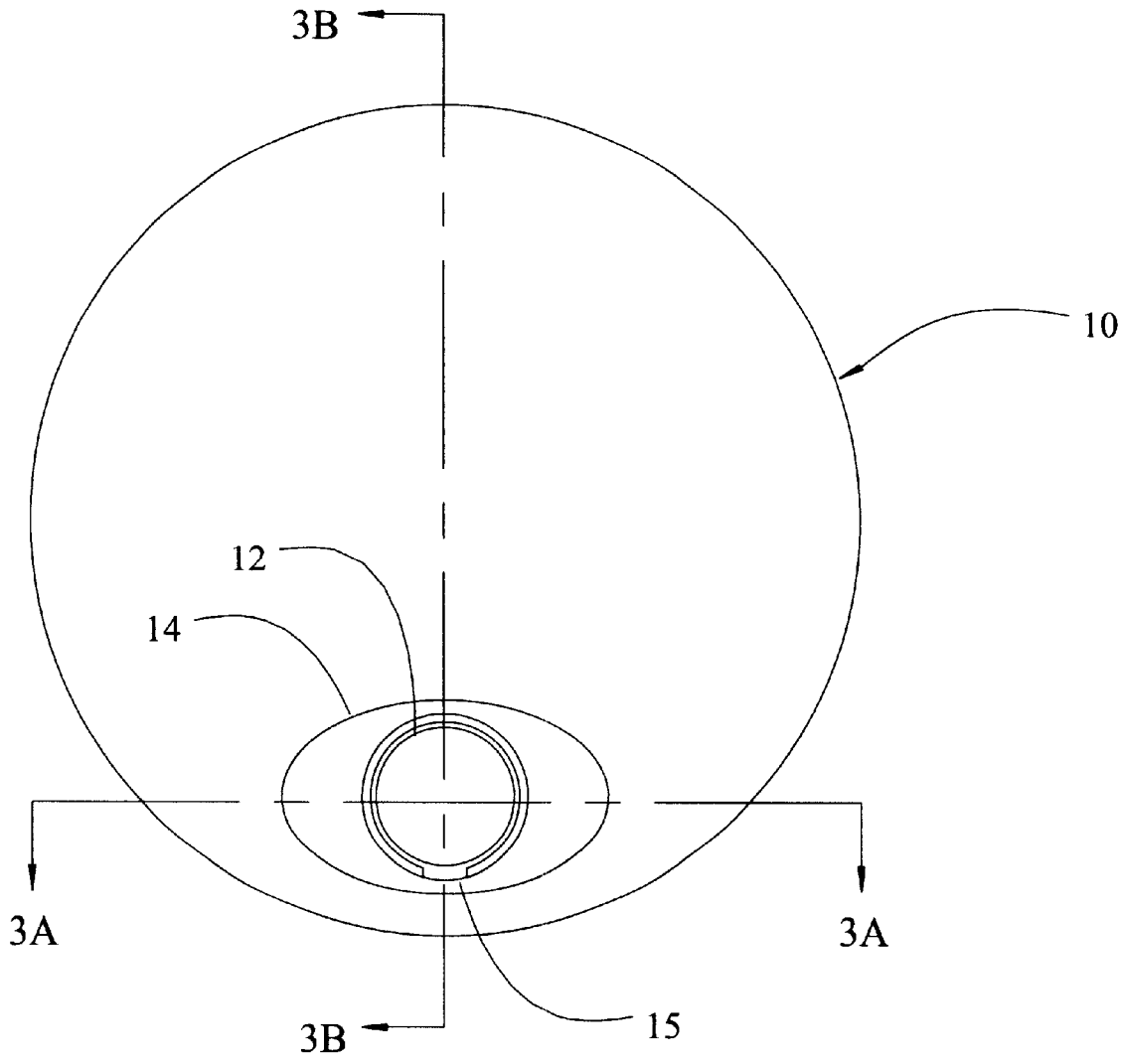
FIG. 3 is a top view of a leak-proof closure without the membrane.
Figure 3A:
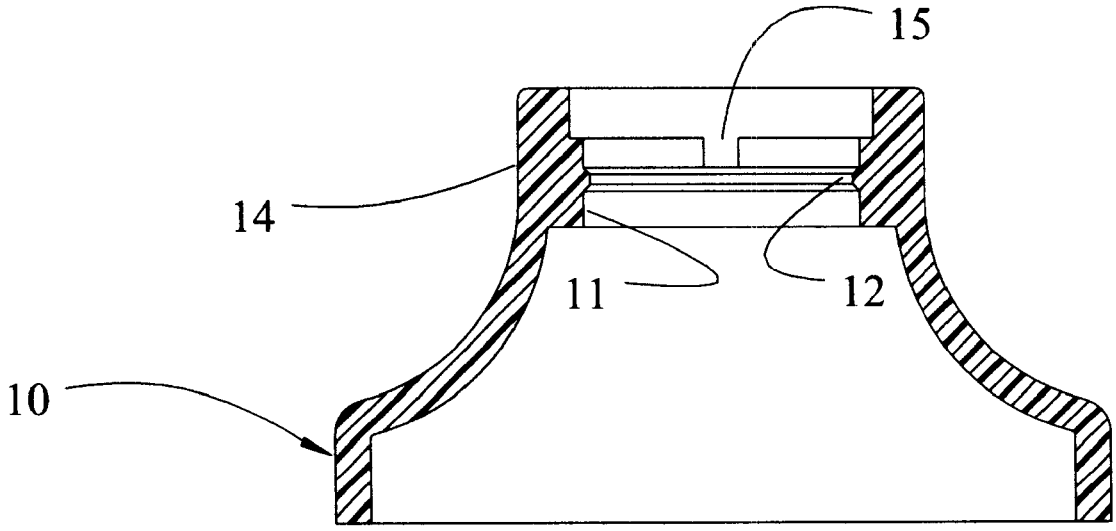
FIG. 3A is the cross-sectional view taken as indicated by section 3A—3A applied to FIG. 3.
Figure 3B:
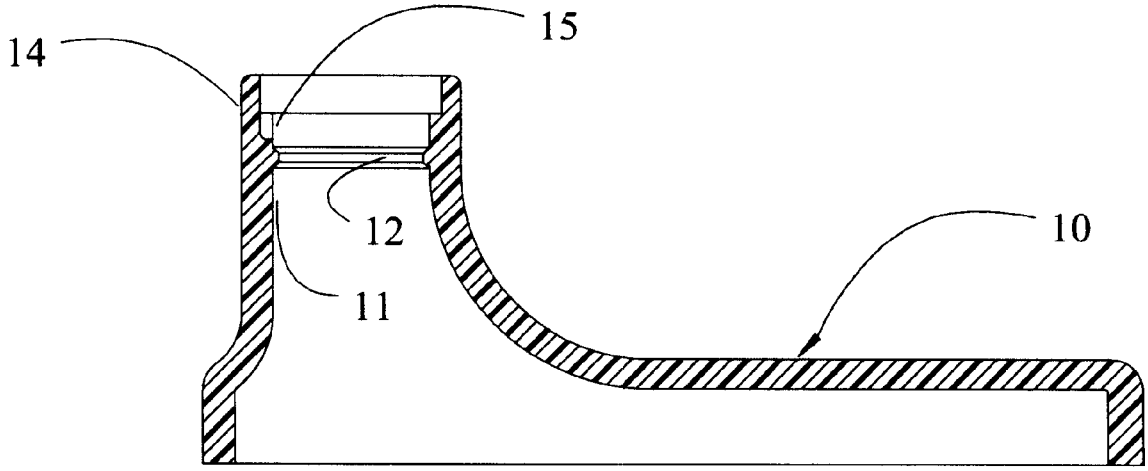
FIG. 3B is the cross-sectional view taken as indicated by section 3B—3B applied to FIG. 3.

Referring to the drawings, the leak-proof closure of the present invention is indicated as reference numeral 10. The closure 10 may be made of materials such as polypropylene, polyethylene, thermoplastic rubbers such as Santoprene, Kraton, etc. or the like and can be reusable or disposable. The closure 10 is circular in shape, having a substantially planar cover portion and may vary in size depending upon the size of the container (not shown). The membrane 13 may be made of formable materials such as Neoprene, Latex, Thermoplastic rubbers such as Santoprene, Kraton, or other elastomers or flexible materials. The outlet passage 14 may be an integral part of, permanently attached to, or removably attachable to the closure 10 and extends outwardly from the top surface thereof. The outlet passage 14 can be made to move or swivel, or it can be fixed or non-movable. The outlet passage 14 can be a variety of geometric shapes but typically would be ovoid or circular in cross-section. The outlet passage 14 has an inner wall 11 and is open at the lower end so as to communicate with the interior of the container (not shown). The upper end of outlet passage 14 is open prior to the attachment of the membrane 13 which is permanently or removably supported within or attached to the inside of outlet passage 14. Typical methods of supporting or attaching the membrane 13 within the outlet passage 14 would include, but is not limited to, friction fits, various adhesives, mechanical retainers, insert molding (molded within), and fusion. Membrane 13 seals off or denies communication between the interior and exterior of the container (not shown). In the manufactured or closed position shown in FIGS. 1, 1A, and 1B, the membrane 13 is unstressed allowing sealing engagement between it and circumferential seal member 12. In the open position shown in FIGS. 2, 2A, and 2B, the membrane 13 is stressed causing disengagement between it and circumferential seal member 12. The flow opening 15 is the only means for communication between the interior and exterior of the container (not shown) when membrane 13 is disengaged from circumferential seal member 12. FIGS. 3, 3A, and 3B show the closure without membrane 13.

Figure 4:
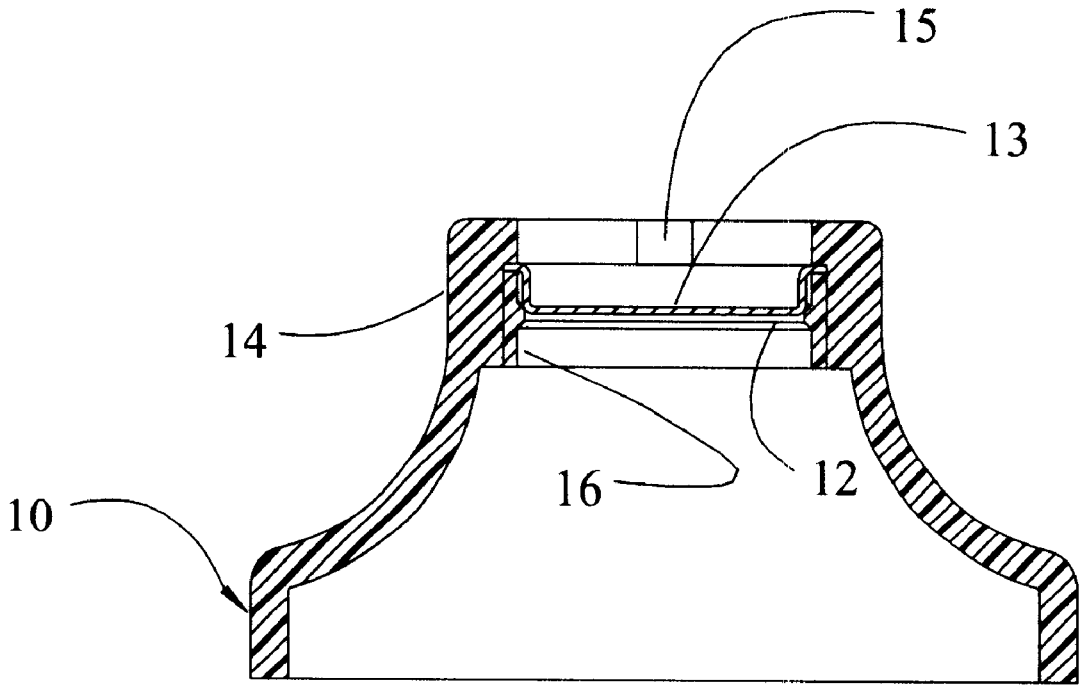
FIG. 4 is the same cross-sectional view as FIG. 1A, showing a variation of the invention.
Figure 4A:
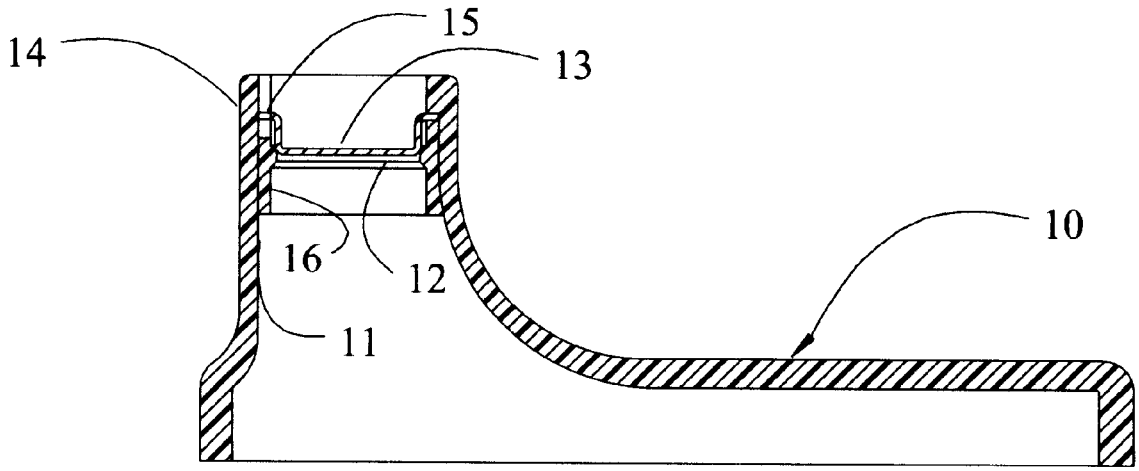
FIG. 4A is the same cross-sectional view as FIG. 1B, showing a variation of the invention.

Another alternative for similar purposes is specifically shown in FIGS. 4 and 4A wherein the membrane 13 is permanently or removably supported within or attached to the inside of outlet passage 14 using retainer ring 16. Circumferential seal member 12 could be an integral part of retainer ring 16 or membrane 13. In all other respects the closure 10 functions as disclosed in FIGS. 1 through 3B and in the written description pertaining thereto.

Figure 5:
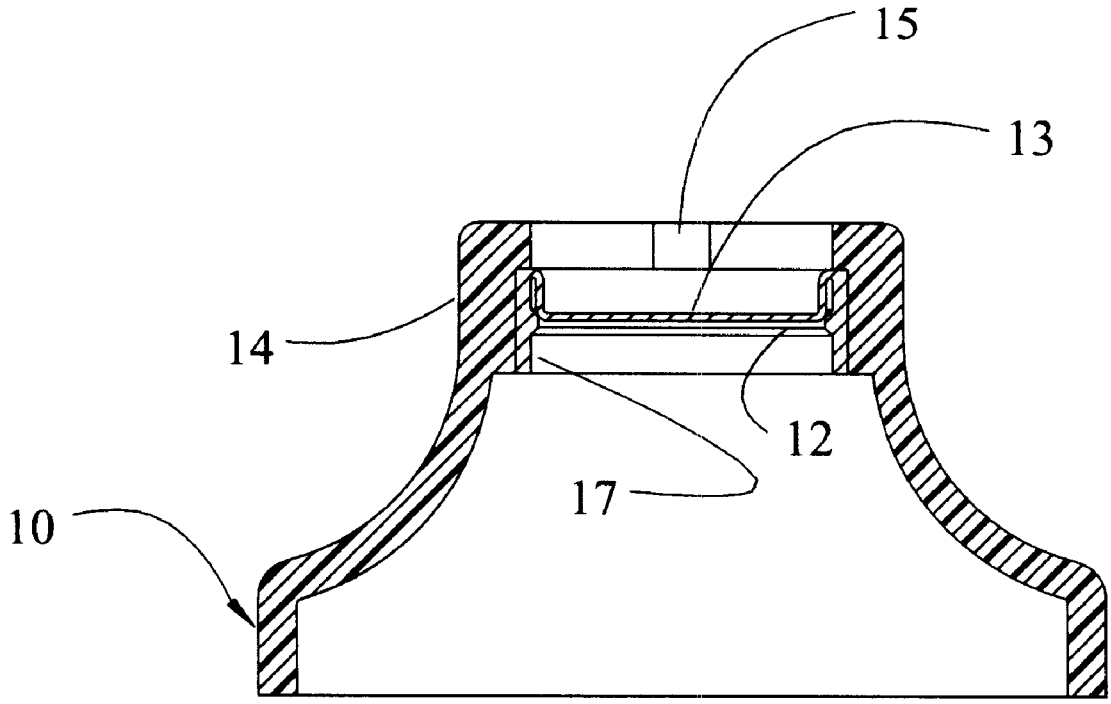
FIG. 5 is the same cross-sectional view as FIG. 1A, showing a variation of the invention.
Figure 5A:
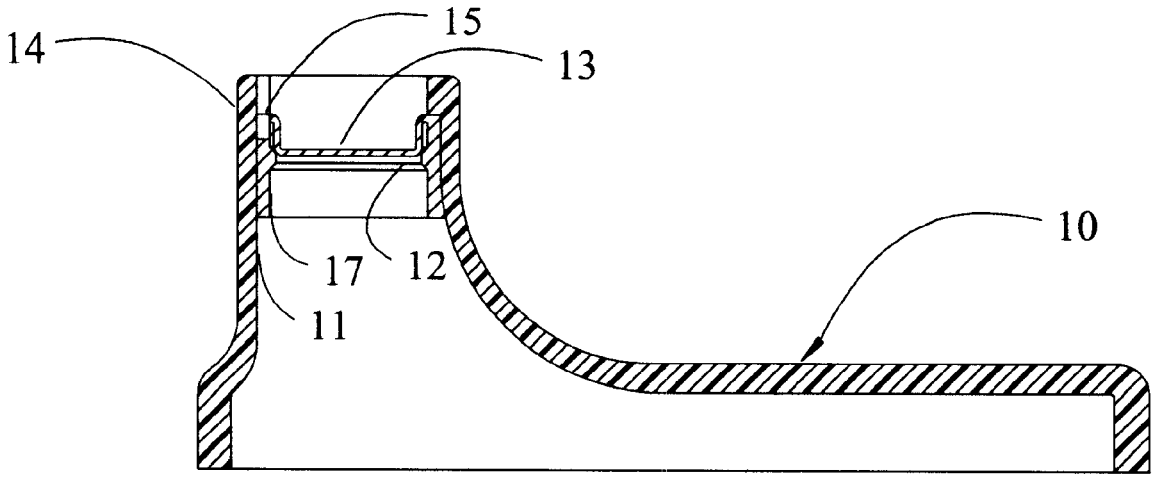
FIG. 5A is the same cross-sectional view as FIG. 1B, showing a variation of the invention.

Another alternative for similar purposes is specifically shown in FIGS. 5 and 5A wherein the valve assembly 17 is permanently or removably attached to the inside of outlet passage 14. The membrane 13, circumferential seal member 12, and flow opening 15 are manufactured as one piece and together they form valve assembly 17 which can be molded from the same materials as membrane 13. The valve assembly 17 and the inner wall 11 of outlet passage 14 are manufactured such that the circumferential seal member 12 will decrease in diameter when supported within or attached to the outlet passage 14. This will allow for membrane 13 to sealingly engage with circumferential seal member 12. Typical methods of supporting or attaching the valve assembly 17 within the outlet passage 14 would include, but is not limited to, friction fits, various adhesives, mechanical retainers, insert molding (molded within), and fusion. In all other respects the closure 10 functions as disclosed in FIGS. 1 through 3B and in the written description pertaining thereto.

Operation—FIGS. 1 through 5A

Membrane 13 is molded or manufactured then inserted into a mold cavity and closure 10 is molded around membrane 13. In the alternate design shown in FIGS. 4 and 4A, the closure 10, membrane 13, and the retainer ring 16 are manufactured separately, then assembled. In the alternate design shown in FIGS. 5 and 5A, the closure 10 and the valve assembly 17 are manufactured separately and then assembled or valve assembly 17 can be molded within outlet passage 14. Since the membrane 13 is biased to its manufactured position, it remain closed unless a partial vacuum or suction is applied to membrane 13 at the upper end of the outlet passage 14. The closure 10 is ready for use and can be attached to a container (not shown).

Figure 1A:
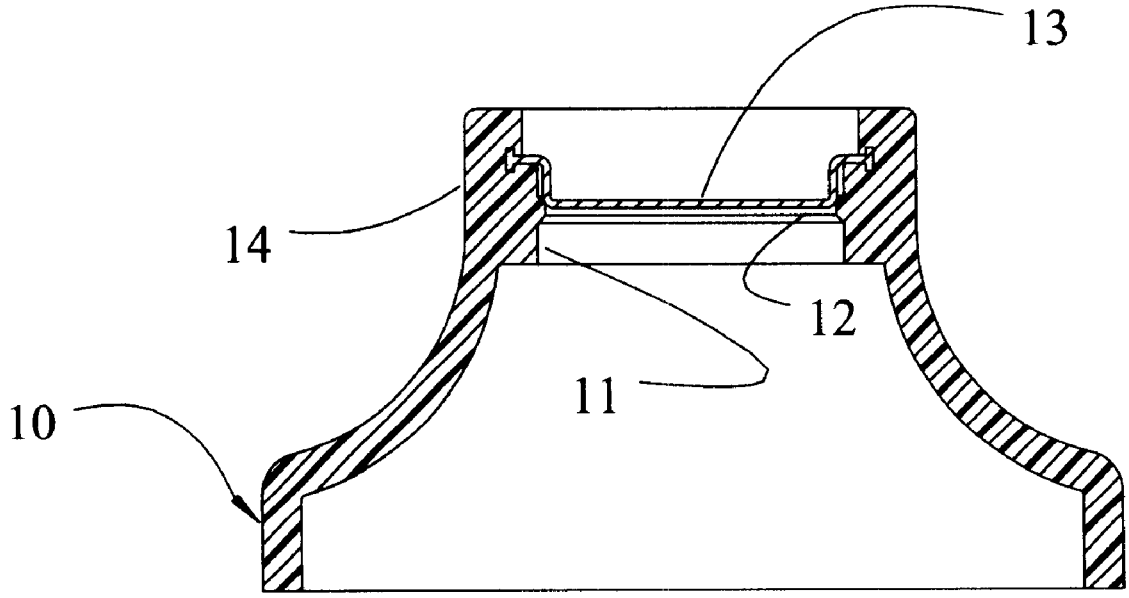
FIG. 1A is the cross-sectional view taken as indicated by section line 1A—1A applied to FIG. 1.
Figure 1B:
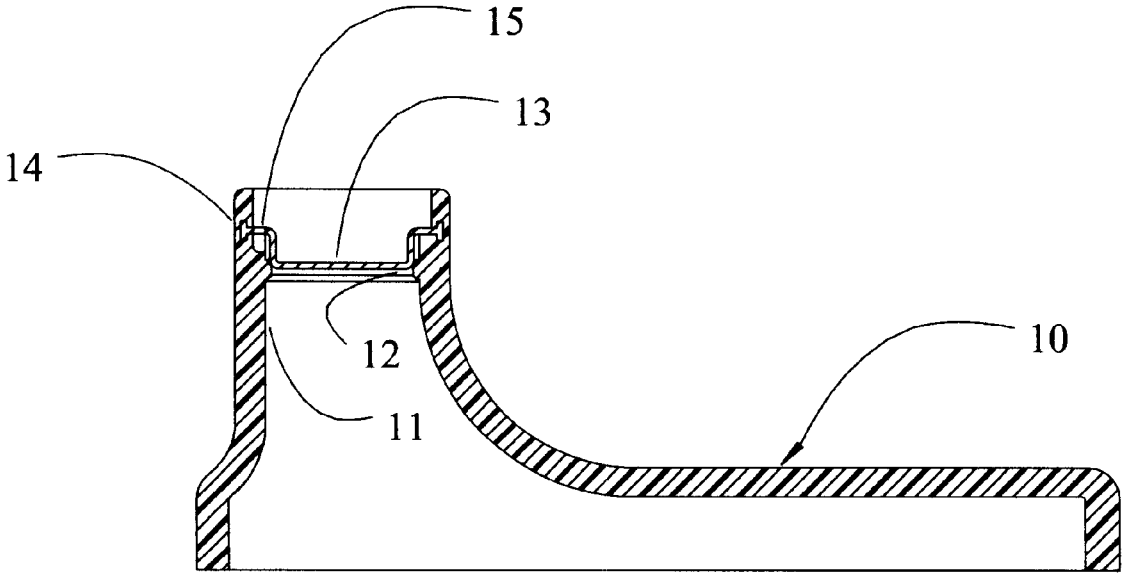
FIG. 1B is the cross-sectional view taken as indicated by section line 1B—1B applied to FIG. 1.

When consumption of the beverage in the container (not shown) is desired, the outlet passage 14 is inserted into the mouth of a user. External suction applied by the user will stress the membrane 13 causing disengagement with circumferential seal member 12 allowing for communication between the interior of the container (not shown) and the user's mouth. This allows for delivery of the contained beverage which flows through flow opening 15. When the suction is released the membrane 13, being biased to its manufactured position, will sealingly engage with circumferential seal member 12 as shown in FIGS. 1, 1A, and 1B thus denying communication between the interior and exterior of the container (not shown). This closed position makes the closure 10, when attached to a container (not shown), a leak-proof device even if tipped or overturned.

SUMMARY, RAMIFICATIONS, AND SCOPE

The closure of the present invention provides the following advantages over prior embodiments:

1) The closure is leak-proof.
2) It will be possible to drink from the container in a normal manner without removing the closure from the container.
3) The closure is a simple structure and may easily be manufactured on conventional plastic forming machines. It may be inexpensively mass produced and does not require piercing, cutting, or slitting the membrane.
4) The closure is a safe device and can be used by small children.

While embodiments of the invention have been described in detail, it is understood that other modifications and various embodiments thereof may be devised by one skilled in the art without departing from the spirit and the scope of the invention, as defined by the claims.

We claim:

1. A valved closure for use in dispensing a liquid from a container, said closure comprising:

a) a cover adapted to close off the open end of said container, said cover comprising an outlet passage, an inner wall, a circumferential seal member, and a flow opening;

b) a membrane defining a central portion and a peripheral portion, said peripheral portion adapted to be attached to said inner wall of said outlet passage, said central portion seated against said circumferential seal member to deny access to said flow opening when said central portion is unstressed and said central portion is unseated from said circumferential seal member to allow direct communication between the interior of said container and the exterior of said cover through said flow opening when said central portion is stressed, said central portion is substantially impervious to liquid flow radially inward of said circumferential seal member when said central portion is engaged with said circumferential seal member.

2. The valved closure according to claim 1 wherein said peripheral portion of said membrane is attached to said inner wall of said outlet passage using a retainer ring.

3. The valved closure according to claim 1 wherein said circumferential seal member and said inner wall are equal in circumference.

4. The valved closure according to claim 1 wherein said central portion of said membrane is curved with respect to a plane parallel to the open end of said outlet passage.

5. The valved closure according to claim 1 wherein said peripheral portion of said membrane is attached to said inner wall of said outlet passage by insert molding.

6. The valved closure according to claim 1 wherein said peripheral portion of said membrane is attached to said inner wall of said outlet passage using a friction fit.

7. The valved closure according to claim 1 wherein said flow opening extends through said peripheral portion of said membrane.

8. A valved closure for use in dispensing a liquid from a container, said closure comprising:

a) an outlet passage including an inner wall;

b) a valve assembly supported within said outlet passage, said valve assembly comprising a circumferential seal member, a flow opening, and a membrane defining a central portion and a peripheral portion, said peripheral portion adapted to be attached to said valve assembly, said central portion shiftable between a closed position where said central portion is sealingly engaged with said circumferential seal member and an open position where said central portion is sealingly disengaged from said circumferential seal member to allow direct communication between the interior of said container and the exterior of said closure through said flow opening, said central portion is substantially impervious to liquid flow radially inward of said circumferential seal member when said central portion is engaged with said circumferential seal member.

9. The valved closure according to claim 8 wherein said valve assembly is supported within said outlet passage using a retainer ring.

10. The valved closure according to claim 8 wherein said central portion of said membrane is curved with respect to a plane parallel to the open end of said outlet passage.

11. The valved closure according to claim 8 wherein said membrane is supported within said cover using a friction fit.

12. The valved closure according to claim 9 wherein said valve assembly and said retainer ring are integrally formed.

13. The valved closure according to claim 8 wherein said flow opening extends through said peripheral portion of said membrane.

14. A valved closure for use in dispensing a liquid from a container, said closure comprising:

a) A cover having an outlet passage defining an inner wall, said inner wall of said outlet passage having a protruding upper membrane seat and a flow opening;

b) a valve assembly supported within said outlet passage, said valve assembly comprising a membrane, a retainer ring located within said outlet passage adjacent said inner wall, said retainer ring supported within said outlet passage, said retainer ring adapted to maintain the outer circumference of said membrane against said upper membrane seat, said retainer ring defining a circumferential seal member, said membrane shiftable between a closed position where said membrane is sealingly engaged with said circumferential seal member and an open position where said membrane is sealingly disengaged from said circumferential seal member, said membrane being contiguous radially inward from the point of contact of said circumferential seal member, so that said membrane is substantially impervious to liquid flow radially inward of said circumferential seal member when said membrane is engaged with said circumferential seal member.

15. The valved closure according to claim 14 wherein said circumferential seal member protrudes radially inward from said retainer ring.

16. The valved closure according to claim 14 wherein said valve assembly is supported within said outlet passage using a friction fit.

17. The valved closure according to claim 14 wherein said valve assembly is supported within said outlet passage by insert molding.

18. The valved closure according to claim 14 said membrane is curved with respect to a plane parallel to the open end of said outlet passage.

19. The valved closure according to claim 14 wherein said retainer ring and said membrane are integrally formed.

20. The valved closure according to claim 14 wherein said flow opening extends though a peripheral section of said membrane.

* * * * *